US005819575A

United States Patent [19]

Kobayashi et al.

[11] Patent Number: 5,819,575

[45] Date of Patent: Oct. 13, 1998

[54] MANUFACTURING APPARATUS OF A CORRUGATED FIN AND METHOD OF MANUFACTURING THE SAME

[75] Inventors: Hisashi Kobayashi, Kariya; Tetuo Ohno, Nagoya; Takashi Kono; Shoji Iriyama, both of Kariya, all of Japan

[73] Assignee: Denso Corporation, Kariya, Japan

[21] Appl. No.: 825,581

[22] Filed: Mar. 31, 1997

[30] Foreign Application Priority Data

Apr. 1, 1996 [JP] Japan ..... 8-79132

[51] Int. Cl.[6] ..... B21D 13/04

[52] U.S. Cl. ..... 72/187; 72/379.6

[58] Field of Search ..... 72/186, 187, 196, 72/379.6

[56] References Cited

U.S. PATENT DOCUMENTS 3,850,018 11/1974 Drosnin .
4,507,948 4/1985 Wallis ..... 72/187
5,176,020 1/1993 Maruo et al. .
5,509,288 4/1996 Ohno et al. .

FOREIGN PATENT DOCUMENTS 63-174920 11/1988 Japan .
1301665 1/1973 United Kingdom ..... 72/187
2252069 7/1992 United Kingdom .

*Primary Examiner*—Lowell A. Larson
*Attorney, Agent, or Firm*—Cushman Darby & Cushman IP Group of Pillsbury Madison & Sutro LLP

[57] ABSTRACT

According to the present invention, a brake unit is disposed at a side of the forward direction of the fin material from a reforming unit. The brake unit contracts the fin material so that the adjacent folded portions contact with each other while being reformed. Thus, the contracted fin material is in a stable state not to be deformed easily. In this way, even if moment tilting flat portions of corrugated fin is given by the reforming unit, the flat portions are prevented from tilting. A concave or convex deformation of the folded portions can be reformed satisfactorily.

8 Claims, 5 Drawing Sheets

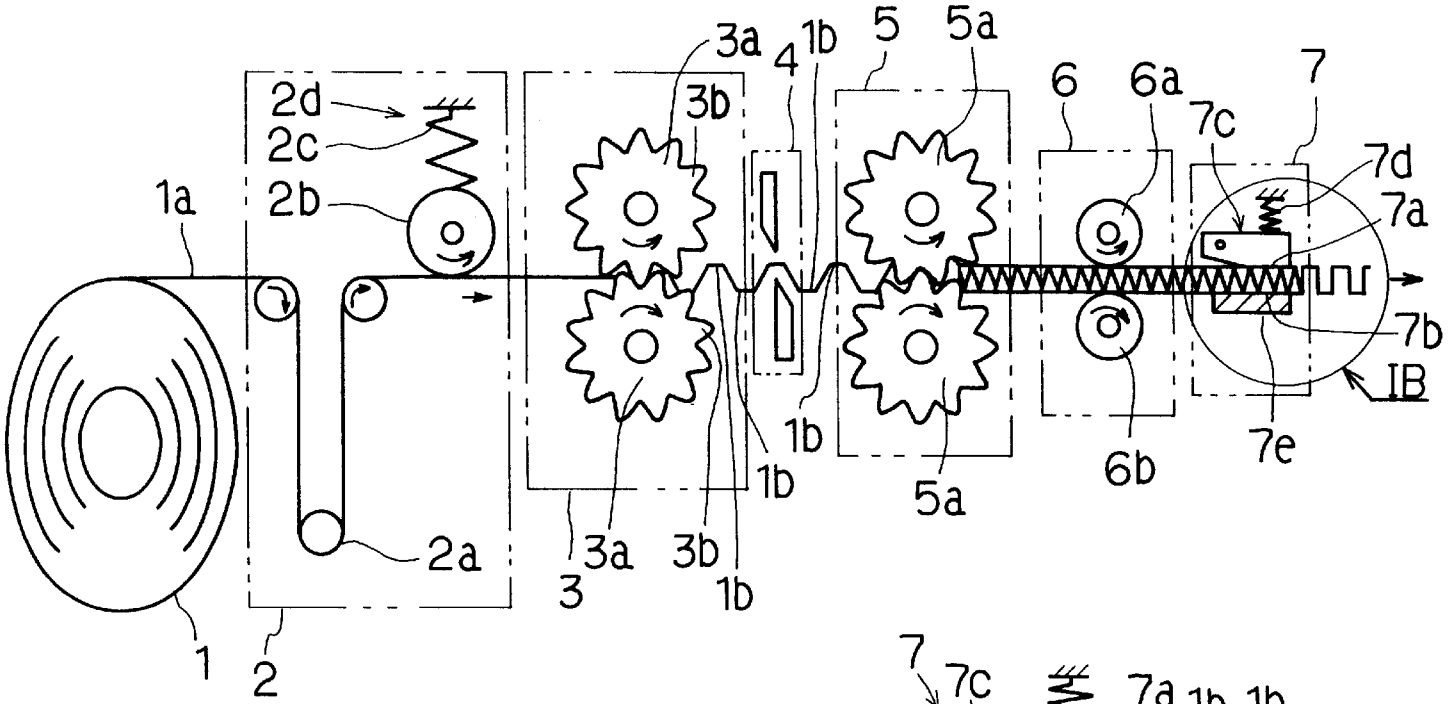
FIG. IA
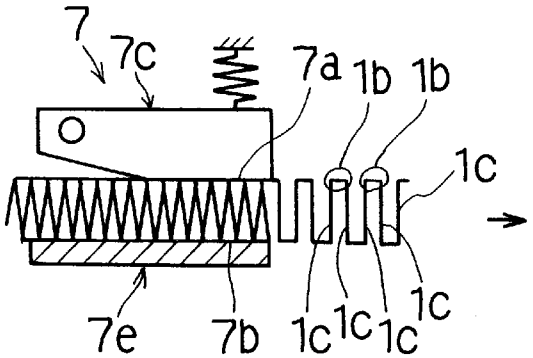
FIG. IB

MANUFACTURING APPARATUS OF A CORRUGATED FIN AND METHOD OF MANUFACTURING THE SAME

CROSS REFERENCE TO THE RELATED APPLICATION

This application is based on and claims priority of Japanese Patent Application No. Hei. 8-79132 filed on Apr. 1, 1996, the content of which are incorporated herein by reference.

BACKGROUND OF THE INVENTION

1. Field of the Invention

The present invention relates to a manufacturing apparatus of a (wavy) corrugated fin for a heat exchanger and is effectively employed to manufacture a corrugated fin having louvers for promoting heat exchanging.

2. Description of Related Art

A corrugated fin manufacturing apparatus generally performs the following processes. First, a thin plate-shaped fin material wound around a material roll is sent between a pair of gear-shaped forming rollers to form plural wavy folded portions. As shown in FIG. 6, louvers 1*d* are provided to flat portions 1*c* connected to the folded portions 1*b*. The fin material is contracted after passing through the forming rollers to have a predetermined fin pitch. Then, the material is cut into a predetermined length.

It is well-known that the louvers 1*d* are manufactured by forming linear slits on the flat portions 1*c* vertically (in the direction of height "h" on a corrugated fin), then, by bending and raising the linear slits in the longitudinal direction of the corrugated fin. When the louvers 1*d* are formed, the edges (the edges in the longitudinal direction of the louvers) 1*d'* of the linear slits deform largely. As shown in FIGS. 7A and 7B, there causes a problem in that the ridges of the folded portions 1*b* deform in concave or convex shapes in the vertical direction of the corrugated fin 1*a*. FIG. 7A shows that a center portion is formed in a concave shape, and FIG. 7B shows a center portion is formed in a convex shape.

To solve this problem, in JP-U-63-174920, there is proposed means for reforming the concave or convex shapes of the folded portions 1*b* by pressing the folded portions substantially perpendicularly to the ridges of the folded portions, with a reforming roller which rotates in accordance with the forward movement of the fin material, after the fin material having passed through the forming rollers is contracted.

The inventors experimentally manufactured a corrugated fin manufacturing apparatus disclosed in the above publication, however, there occurs a tilting defect in which the flat portions 1*c* tilt in the longitudinal direction of the corrugated fin as shown in FIG. 8B. To solve the problem, resulting from a study of causes of the tilting defect, the inventors have found that the tilting defect occurs due to the following reasons.

In the corrugated fin manufacturing apparatus disclosed in the above publication, because there is no provided with guide means such as a guide for restricting the deformation of the fin material after the material passes through the reforming rollers, the fin material 1*a* after passing through the reforming rollers is in a unstable state to be deformed easily.

Furthermore, because the fin material 1*a* is formed in a wavy shape as shown in FIG. 8A, a contact point 61, where a reforming roller 6*a* at an upper side in the drawing contacts with the folded portion 1*b*, and a contact point 62, where a reforming roller 6*b* at a lower side in the drawing contacts with the folded portion 1*b*, are shifted from each other in the forward direction of the fin material 1*a*.

Accordingly, a moment is applied on the fin material 1*a* to tilt the flat portions 1*c* of the corrugated fin. In addition, there is no provided with the above-described guide means after the material passes through the reforming rollers. Therefore, the corrugated fin tilts after passing through the reforming rollers.

SUMMARY OF THE INVENTION

In light of the above-described problem, the present invention has an object of reducing the tilting defect of the corrugated fin in a manufacturing process.

According to the present invention, a brake unit is disposed at a side of a forward direction of the fin material from a reforming unit, and contracts the fin material after the folded portions are reformed, such that the adjacent folded portions of the plural folded portions contact with each other in the reforming unit.

In other words, the brake unit contracts the fin material to bring the adjacent folded portions into contact with each other while being reformed. As a result, the fin material becomes stable without being deformed. Even if the reforming unit gives the moment to tilt the flat portions on the fin material, the flat portions are suppressed from tilting, and the corrugated fin is prevented from tilting. Furthermore, the yield of corrugated fins improves, which reduces the manufacturing cost of the corrugated fins.

Further, the reforming unit may be equipped with a pair of reforming rollers which hold the fin material and rotate in accordance with the forward movement of the fin material, outer diameters of reforming rollers may be set for 15 to 35 times as long as the distance (L) between the adjacent folded portions when the brake unit contracts the fin material.

Consequently, a time period during which the reforming rollers contact with the fin material at three points is approximately 70% of the total time period during which the reforming rollers contact with the fin material. The moment acting on the fin material can be suppressed, and the tilting defect can be reduced.

According to another aspect of the present invention, the fin material after the folded portion is reformed into a predetermined shape is contracted such that the folded portions contact with each other while being reformed.

In this way, even if moment tilting the flat portion acts on the fin material while the folded portion is reformed, the flat portion is suppressed from tilting.

BRIEF DESCRIPTION OF THE DRAWINGS

Additional objects and advantages of the present invention will be more readily apparent from the following detailed description of preferred embodiments thereof when taken together with the accompanying drawings in which:

FIG. 1A is a schematic view showing a corrugated fin manufacturing apparatus according to a first embodiment, and FIG. 1B is an enlarged view showing the part 1B of FIG. 1A;

DETAILED DESCRIPTION OF THE PREFERRED EMBODIMENTS

Embodiments according to the present invention are hereinafter described with reference to the accompanying drawings.

A first embodiment of the present invention will be described.

FIG. 1 is a schematic view of a corrugated fin manufacturing apparatus according to this embodiment. Thin plate-shaped fin material 1*a* is wound around a material roll (uncoiler) 1. A predetermined tension is given to the fin material 1*a* taken out from the material roller by a tension unit 2. The tension unit 2 has a weight tension portion 2*a* for giving a constant tension on the fin material 1*a* by gravity, a roll 2*b* which rotates in accordance with the forward movement of the fin material 1*a*, and a roll tension portion 2*d* including spring means 2*c* for giving a predetermined tension on the fin material 1*a* via the roll 2*b*.

Figure 6:
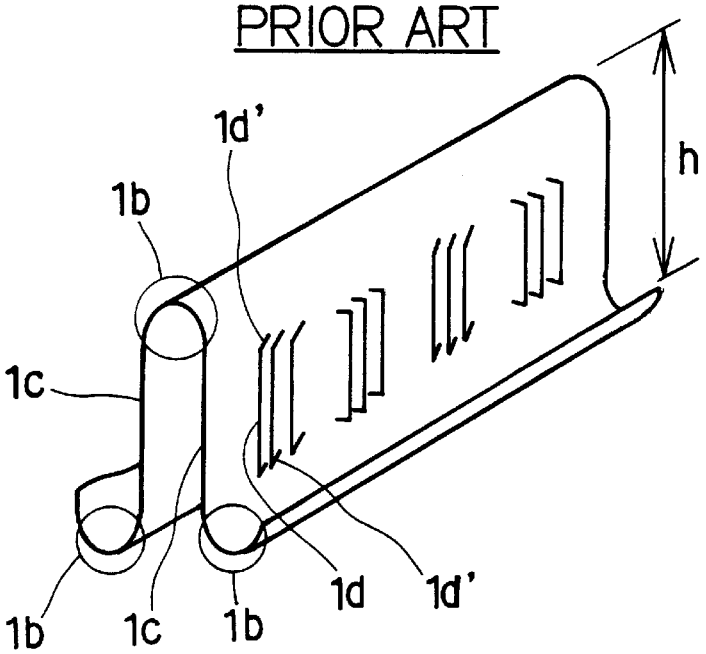
FIG. 6 PRIOR ART
FIG. 6 is a perspective view of a corrugated fin.
Figure 7A:
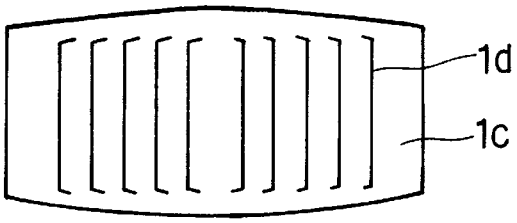
FIG. 7A PRIOR ART
FIGS. 7A and 7B are explanatory views showing a concave shape and a convex shape, occurring on the folded portions of the corrugated fin, respectively.
Figure 7B:
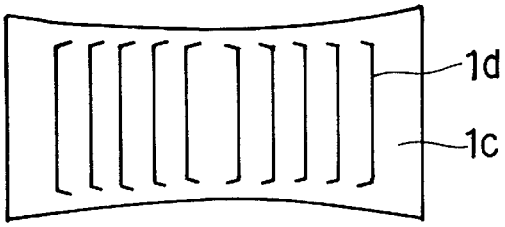
FIG. 7B PRIOR ART
Figure 8A:
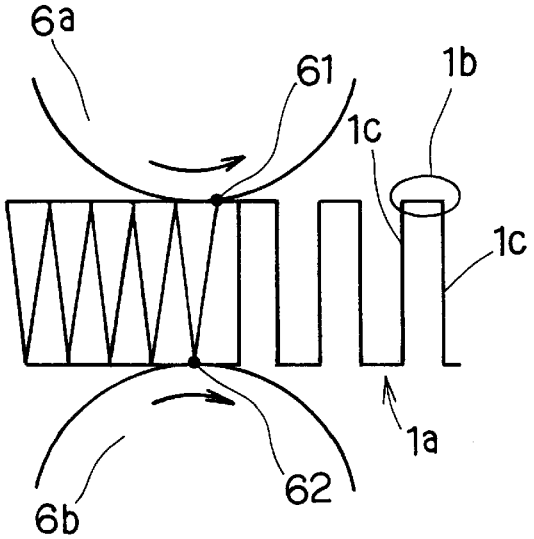
FIG. 8A PRIOR ART
FIGS. 8A and 8B are explanatory views of a tilting defect of the corrugated fin.
Figure 8B:
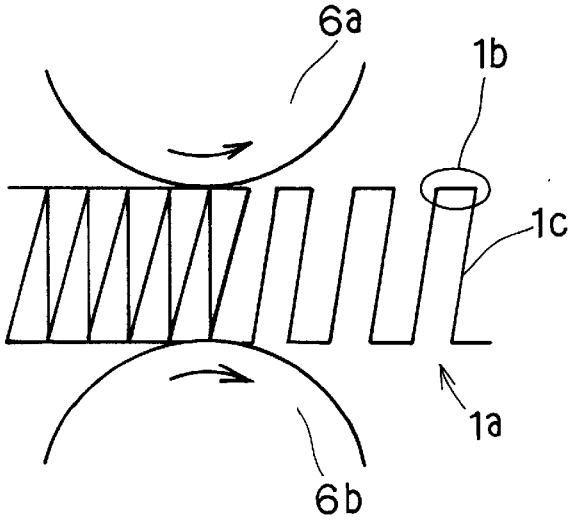
FIG. 8B PRIOR ART

The reason why the tension unit 2 gives the predetermined tension on the fin material 1*a* is to maintain constant the height "h" (FIG. 6) of the corrugated fin which is folded by a fin forming unit 3 (described later).

The fin forming unit 3 forms the fin material 1*a*, to which the predetermined tension is given by the tension unit 2, with plural rectangular folded portions 1*b* into a wavy shape, and also forms louvers 1*d* (FIG. 6) for promoting heat-exchanging on the flat portions 1*c* connected to the folded portions 1*b*. The fin forming unit 3 is composed of a pair of gear-shaped forming rolls 3*a*, a cutter (not shown) disposed on the teeth of the forming rolls 3*a* to form the louvers 1*d*. When the fin material 1*a* passes between the forming rolls 3*a*, the material is folded along the teeth 3*b* of the forming rolls 3*a* while being formed with the folded portions 1*b* and the louvers 1*c*.

A cutting unit 4 cuts the fin material 1*a* having the folded portions 1*b* and the louvers 1*d*. The cutting unit 4 cuts the fin material 1*a* in a predetermined length so that one corrugated fin has a predetermined number of the folded portions 1*b*. A feeding unit 5 sends the fin material 1*a* cut by the predetermined length to a reforming unit 6 described later. The feeding unit 5 is composed of a pair of gear-shaped feeding rollers 5*a*, which have substantially the same basic pitch as the distance between the folded portions 1*b* formed by the fin forming unit 3.

When a fin pitch (a distance between the adjacent folded portions 1*b*) is decreased in a finished state of the corrugated fin, a pressure angle of the forming rolls 3*a* are set larger. When the fin pitch is increased, the pressure angle are set smaller. If a module difference between the forming rollers 3*a* and the feeding rollers 5*a* is within 10%, the corrugated fin can be formed without changing the feeding rollers 5*a*.

The reforming unit 6 presses the folded portions 1*b* substantially perpendicularly to the ridges of the folded portions 1*b* to reform the concave or convex shape of the folded portions 1*b*. The reforming unit 6 has a pair of reforming rollers 6*a* and 6*b* to hold the fin material 1*a* therebetween. The reforming rollers 6*a* and 6*b* rotate while being subject to the forward movement of the fin material 1*a*. The reforming rollers 6*a* and 6*b* are disposed such that a line connecting between rotation centers of the reforming rollers 6*a* and 6*b* is perpendicular to the forward direction of the fin material 1*a*.

A brake unit 7 has brake surfaces 7*a* and 7*b* which generate friction toward the backward direction of the fin material 1*a* by contacting the plural folded portions 1*b*. The brake unit 7 is disposed at the forward side of the fin material 1*a* from the reforming unit 6. Feeding force generated by the feeding unit 5 and friction generated by the brake surfaces 7*a* and 7*b* contract the fin material 1*a* so that the folded portions 1*b* of the fin material 1*a* contact with each other.

One end of a brake shoe 7*c* having a brake surface 7*a* is rotatably supported, and at a side of the other end there is disposed a spring member 7*d* functioning as a friction regulating mechanism. Friction generated by the brake surfaces 7*a* and 7*b* is adjusted by regulating a deformed amount of the spring member 7*d*. A plate 7*e* forming the brake shoe 7*c* and the brake surface 7*b* is made of a high anti-abrasion material. For example, die steel is employed in this embodiment.

An operation of the corrugated fin manufacturing apparatus according to this embodiment is hereinafter described in the order of the processes performed in the corrugated fin manufacturing apparatus.

The fin material 1*a* is drawn out from the material roll 1 (drawing process). A predetermined tension is given to the drawn fin material 1*a* in the forwarding direction of the fin material 1*a* (tension generating process). The fin forming unit 3 forms the folded portions 1*b* and the louvers 1*d* on the fin material 1*a* (fin forming process) and the cutting unit 4 cuts the fin material with a predetermined length (cutting process).

Next, the feeding unit 5 feeds the fin material 1*a* cut into the predetermined length to the reforming unit 6 (feeding process). The reforming unit 6 presses the folded portions 1*b* to reform the concave or convex shapes thereof (reforming). The brake unit 7 contracts the fin material 1*a* so that the adjacent folded portions 1*b* can contact with each other (contracting process).

After finishing the contracting process, the fin material 1*a* extends by its own elasticity to have a predetermined fin pitch. After inspection processes such as an inspection of the dimension, corrugated fins are finished being formed.

Characteristics of the present embodiment is hereinafter described.

The brake unit 7 disposed at the forward side of the fin material 1*a* from the reforming unit 6 presses and contracts the fin material 1*a*, so that the adjacent folded portions 1*b* can contact with each other. Consequently, the fin material 1*a* is in a stable state not to be deformed easily. Accordingly, even if a moment acts on the fin material 1*a* to tilt the flat portions 1*c*, the flat portions 1*c* do not tilt, and therefore, it is possible to prevent the tilting defect while reforming the concave or convex shapes of the folded portions 1*b*.

Further, since the spring member 7*d* is provided as a friction regulating mechanism, by adjusting a deformed amount of the spring member 7*d*, the friction generated by the brake surfaces 7*a* and 7*b* can be easily regulated. Therefore, it is possible to prevent an adverse influence that the folded portion 1*b* is folded excessively and the fin material 1*a* is crushed, which are caused by an excessive friction force acting on the fin material 1*a*. Thus, a decrease in production yield of corrugated fins can be suppressed. In addition, the manufacturing cost of the corrugated fins can be reduced as well as the manufacturing cost of heat exchangers using such corrugated fins.

A second embodiment of the present invention will be described.

An object of this embodiment is to reduce moment generated by the reforming rollers 6*a* and 6*b* to further reduce the tilting defect of the flat portions 1*c*.

Figure 2:
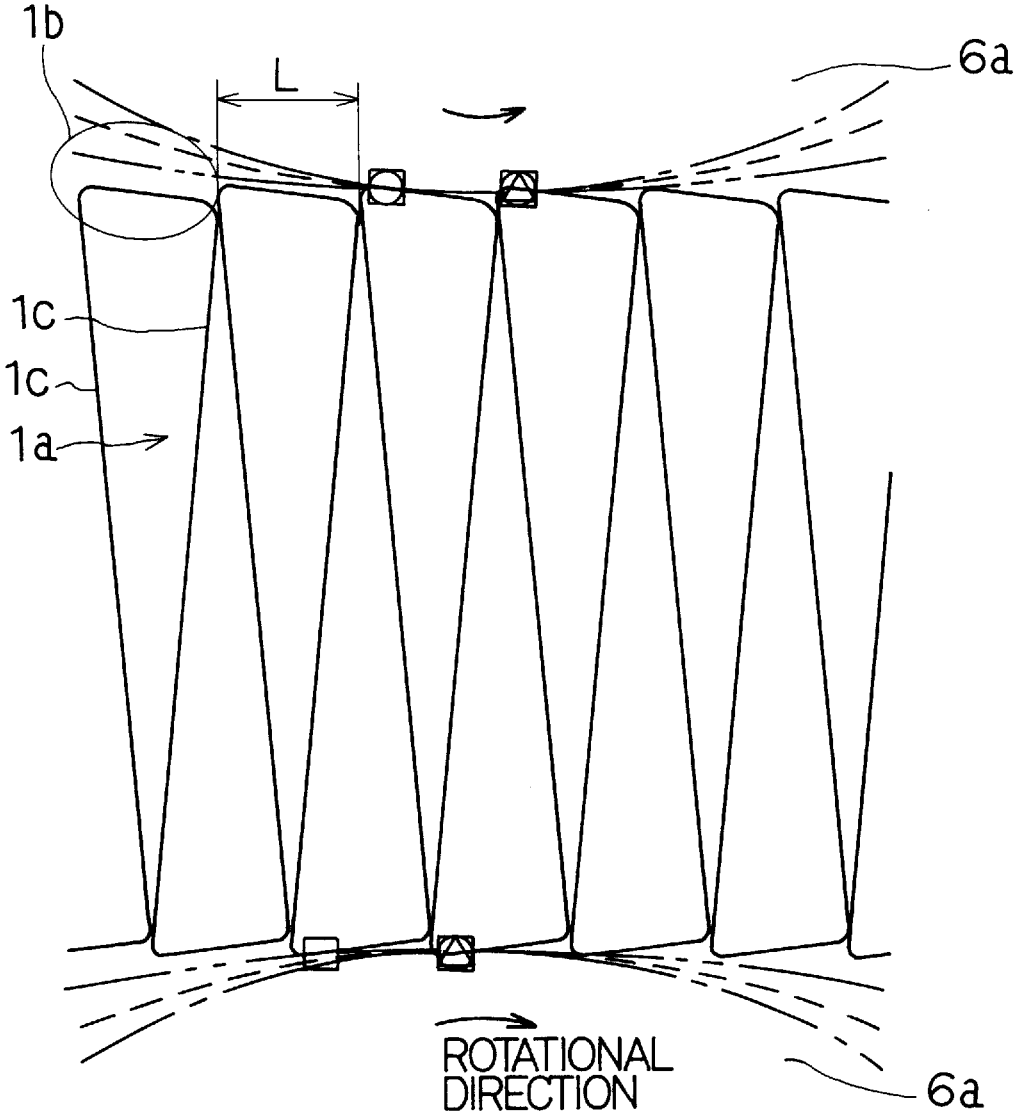
FIG. 2 is an enlarged view of the contact points between reforming rollers and a fin material.

More specifically, outer diameters of the reforming rollers 6*a* and 6*b* are set in 15–35 times as long as the distance "L" of the adjacent folded portions 1*b* when the fin material 1*a* is contracted (contracting process) so that the adjacent folded portions 1*b* can contact with each other (FIG. 2).

The reason why the tilting defect can be reduced according to the above-described structure is described below with reference to FIG. 2.

FIG. 2 is an enlarged view of contact points of the reforming rollers 6*a* and 6*b* and the folded portions 1*b*. As being obvious from FIG. 2, when the fin material 1*a* is forwarded from the left to the right in the drawing, the contact points also vary. To simplify the following consideration, a specified portion of the fin material 1*a* is focused. Such a focused portion is considered in detail.

If the outer diameters of the reforming rollers 6*a* and 6*b* are small as shown by one-dot lines in FIG. 2, the fin material 1*a* and the reforming rollers 6*a* and 6*b* contact at two points shown by Δ in the drawing. Two contact points cause tilting defect due to the moment acting on the flat portions 1*c*.

If the outer diameters of the reforming rollers 6*a* and 6*b* are large as shown by two-dot lines in FIG. 2, the fin material 1*a* and the reforming rollers 6*a* and 6*b* contact at four points shown by □ in the drawing. Four contact points can suppress the generation of moment which causes the tilting defect. However, due to the increased contact points, a reforming force for reforming the fin material 1*a* becomes large, and rotational resistance of the reforming rollers 6*a* and 6*b* also becomes large. If the rotational resistance of the reforming rollers 6*a* and 6*b* is excessively large, the folded portions 1*b* may be bent excessively, and there occurs an adverse influence that the fin material 1*a* may be crushed.

Considering the above systematically, the inventors reach a conclusion that the contact points of the fin material 1*a* and the reforming rollers 6*a* and 6*b* should be three.

However, actually, the reforming rollers 6*a* and 6*b* rotate in accordance with the forward movement of the fin material 1*a*. The number of contact points is not fixed, but changes continuously from two to three, and from three to four. To reduce the above conclusion into the practice, it is desirable to extend the time period during which the number of the contact points is three in the total time period during which the reforming rollers 6*a* and 6*b* contact with the fin material 1*a*. Resulting from various studies, the inventors have concluded that the time period during which the number of the contact points are three should be approximately 70% in the total time period during which the reforming rollers 6*a* and 6*b* contact with the fin material 1*a*.

When calculating the outer diameters of the reforming rollers 6*a* and 6*b* practically from the conclusion, the outer diameters are 15 to 35 times as long as the distance L of the adjacent folded portions 1*b*.

Therefore, by setting the diameters for 15 to 35 times as long as the distance L of the adjacent folded portions 1*b*, the tilting defect can be further prevented in addition to the effect of the brake unit 7.

Further, as means for suppressing the moment generated when the number of the contact points is two, considering a deviated amount of both contact points, the rotation centers of the reforming rollers 6*a* and 6*b* may be shifted; however, such an adjustment is too difficult to be practical.

Figure 3:
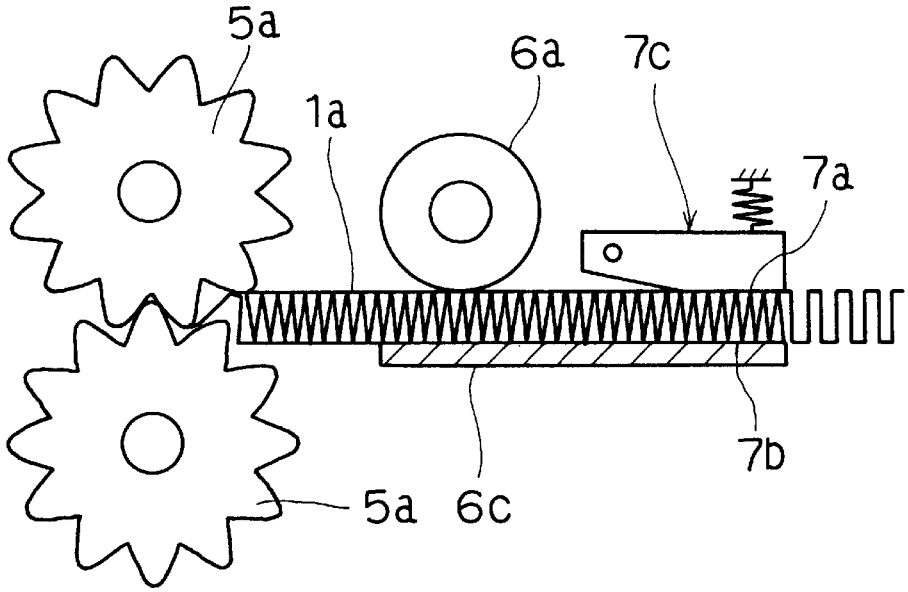
FIG. 3 is a schematic view showing a modification of a correction unit.

Although two reforming rollers are employed in the above-described embodiments, only one reforming roller 6*a* may be employed with a plate 6*c* which is disposed at an opposite side of the reforming roller 6*a* as shown in FIG. 3.

Figure 4:
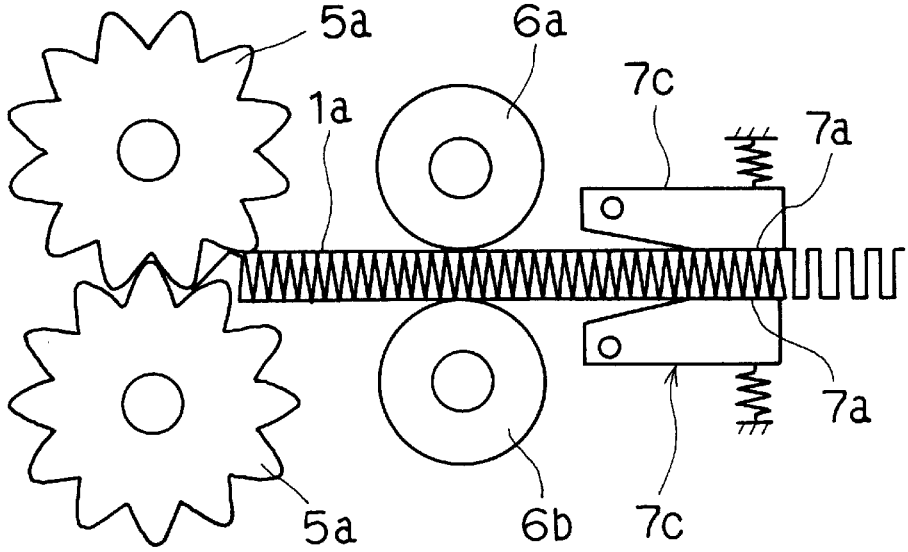
FIG. 4 is a schematic view showing a modification of a brake unit.

Although the brake unit 7 is composed of the brake shoe 7*c* and the plate 7*e* in the above-described embodiments, a pair of brake shoes 7*c* may be employed instead of the plate 7*e* as shown in FIG. 4.

Figure 5:
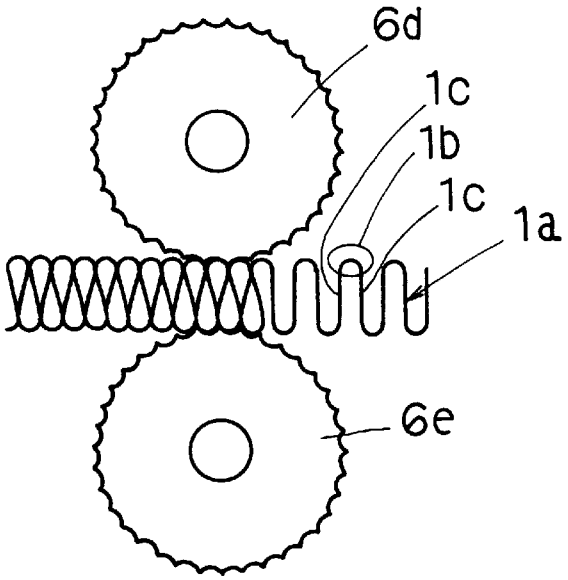
FIG. 5 is a schematic view showing the brake unit when manufacturing a wavy sine shaped-corrugated fin.

The above embodiments describe a manufacturing method of wavy rectangular corrugated fins, however, the shape of the corrugated fins are not limited to a wavy rectangle. The present invention can be applied to wavy sine-shaped corrugated fins (whose folded portions have smooth curves). In this case, the brake shoe 7*c* may be replaced with the star-shaped brake rollers 6*d* and 6*e* as shown in FIG. 5 to apply braking force to the rotation of the brake rollers 6*d* and 6*e*.

Furthermore, the reforming rollers 6*a* and 6*b* in the above embodiments rotate while being subject to the forward movement of the fin material 1*a*, however, the reforming rollers 6*a* and 6*b* may be actively rotated by a motor or the like. In this way, even if a ratio where the state of the four contact points occupies becomes larger, it is possible to prevent the adverse influence in which the fin material 1*a* is crushed due to an increase in the rotational resistance of the reforming rollers 6*a* and 6*b*. Further, since the ratio where the four contact points occupies becomes larger, the tilting defect can be further suppressed.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A corrugated fin manufacturing apparatus for manufacturing a corrugated fin continuously from a thin plate fin material, said corrugated fin having alternately a plurality of folded portions and flat portions, said flat portions being formed with a louver for promoting heat exchange, said manufacturing apparatus comprising:

a fin forming unit having a pair of gear-shaped rollers having teeth for forming the plurality of said folded portions on the thin plate fin material such that said thin plate fin material is formed into a wavy shape, said fin forming unit for forming a plurality of said louvers;

a reforming unit, having a pair of rollers which hold said fin material and rotate in accordance with a forward movement of said fin material, for pressing said folded portions substantially perpendicularly to ridges of said folded portions to reform each of said folded portions into a predetermined shape; and a brake unit disposed at a side of said reforming unit in a forward direction of said fin material from said reforming unit, for contracting said fin material such that adjacent folded portions of said plurality of folded portions contact each other in said reforming unit, wherein said brake unit prevents said folded portions from being tilted.

2. A corrugated fin manufacturing apparatus according to claim 1, wherein outer diameters of said reforming rollers are 15 to 35 times as long as a distance (L) between adjacent folded portions when said fin material is contracted by said brake unit.

3. A corrugated fin manufacturing apparatus according to claim 1, wherein said brake unit contracts said fin material substantially in the forward direction of said fin material.

4. A corrugated fin manufacturing apparatus according to claim 1, further comprising a cutter disposed on said teeth of the forming rollers, for forming said louvers.

5. A corrugated fin manufacturing apparatus according to claim 4, further comprising:

a feeding unit, for sending said fin material from said fin forming unit to said reforming unit, said feeding unit including a pair of gear-shaped feeding rollers.

6. A corrugated fin manufacturing apparatus according to claim 5, wherein a module difference between said forming rollers of said fin forming unit and said feeding rollers of said feeding unit is within 10%.

7. A method of manufacturing a corrugated fin continuously from a thin plate fin material, said corrugated fin having alternately a plurality of folded portions and flat portions, said flat portions being formed with a louver for promoting heat exchange, said method comprising:

a fin forming step for forming the thin fin material into a wavy shape using a pair of gear-shaped rollers having teeth;

a reforming step for pressing said folded portions of said fin material to reform each of said folded portions to a predetermined shape by using a pair of rollers which hold said fin material and rotate in accordance with a forward movement of said fin material; and a contracting step for contracting said fin material such that said folded portions contact each other in said reforming step, wherein said contracting step prevents said folded portions from being tilted.

8. A method of manufacturing a corrugated fin according to claim 7, wherein said fin material is contracted substantially in the forward direction of said fin material.

* * * * *